US005645793A

United States Patent [19]

Yamamoto et al.

[11] Patent Number: 5,645,793

[45] Date of Patent: Jul. 8, 1997

[54] CARTRIDGE HANDLING HAND OF A CARTRIDGE SYSTEM SLIDING VALVE APPARATUS FOR A MOLTEN METAL VESSEL

[75] Inventors: Kenji Yamamoto, Okayama-ken; Mototsuga Osada, Bizen; Shuichi Aoyama; Koji Ishii, both of Okayama, all of Japan

[73] Assignee: Shinagawa Refractories Co., Ltd., Tokyo, Japan

[21] Appl. No.: 504,577

[22] Filed: Jul. 20, 1995

[30] Foreign Application Priority Data

Jul. 29, 1994 [JP] Japan ..... 6-178167

[51] Int. Cl.[6] ..... C22B 7/00; B22D 41/08

[52] U.S. Cl. ..... 266/287; 266/DIG. 1; 222/600

[58] Field of Search ..... 222/597, 600; 266/DIG. 1, 236, 287

[56] References Cited

FOREIGN PATENT DOCUMENTS

| | | | |
|---|---|---|---|
| 0039165 | 4/1981 | Japan | 222/600 |
| 406023521 | 2/1994 | Japan | 222/600 |
| 406154969 | 6/1994 | Japan | 222/600 |
| 406190542 | 7/1994 | Japan | 222/600 |

*Primary Examiner*—Scott Kastler

*Attorney, Agent, or Firm*—Larson & Taylor

[57] ABSTRACT

A cartridge handling hand of a cartridge system sliding valve apparatus for a molten metal vessel is mountable to a general purpose robot. The hand includes a cartridge pressing cylinder secured to a mounting plate whose one side surface is provided with a device for mounting a carrier arm. A first pair of cylinder support arms for lock pins and a second pair of support arms are attached vertically to the other side surface of the mounting plate. Lock pins are attached to piston rod ends of cylinders which are secured to the cylinder support arms 2. Cartridge clamp arms are slidably fitted into guide pins provided vertically in the outside of the second pair of support arms. The cartridge clamp arms are coupled through a cylinder which opens or closes the arms. A cartridge system sliding valve apparatus includes positioning metal fittings for interfitting with the lock pins of the cartridge handling hand of the invention and positioning pins which fit in the positioning recesses of a cartridge.

5 Claims, 4 Drawing Sheets

CARTRIDGE HANDLING HAND OF A CARTRIDGE SYSTEM SLIDING VALVE APPARATUS FOR A MOLTEN METAL VESSEL

INDUSTRIAL FIELD OF THE INVENTION

FIELD OF THE INVENTION

This invention relates to a cartridge handling hand of a cartridge system sliding valve (hereinafter referred to as SV) apparatus and to a cartridge system SV apparatus where said hand is applicable.

BACKGROUND OF THE INVENTION

A plate brick to the SV apparatus has so far been replaced manually. However, as known to a person skilled in the art, a cartridge system SV apparatus is becoming generalized these days, in which a housing (hereinafter referred to as cartridge) storing a plate brick in advance is used to form an assembly, and said cartridge assembly in entirety is replaced to the SV apparatus.

A cartridge assembly storing a brick is 30 to 100 kg in its total weight, so that it is heavy work to manually replace said assembly. On the other hand, as the means of mechanically handling a cartridge assembly there may be a system where the cartridge assembly is clamped by using an arm mechanism or a sytem where a vacuum adsorbing mechanism is used. However, is many occasions a plate brick to the SV apparatus in replaced usually in the vertical form of the SV apparatus i.e. in the form where a molten metal vessel is vertically reversed, and the cartridge system SV apparatus has the undermentioned problems in particular. Thus, it will be evident that in the systems of employing the arm mechanism and the vacuum adsorbing mechanism it is impossible to replace the cartridge assembly.

(a) Since a surface pressure is applied to the plate brick after the cartridge assembly has been conveyed to the SV apparatus it is necessary to press-in the plate brick to a predetermined position of the SV apparatus.

(b) Even in the case in which a new replacement cartridge assembly is inserted into the SV apparatus or a used cartridge assembly is taken out from said apparatus it is required to position the cartridge assembly and the handling device (such as hands of robot apparatus).

(c) In order that the plate brick of the SV apparatus is connected to a power source for sliding the plate brick, it is necessary to mechanically connect the cartridge assembly to the SV apparatus.

SUMMARY OF THE INVENTION

The inventors of the present invention have conducted extensive research and experiments to solve the various drawbacks of the known techniques, and as a result they have been successful in developing the present invention. In a first embodiment of the invention, a cartridge handling hand of a cartridge system sliding valve apparatus for a molten metal vessel resides is a cartridge pressing cylinder 10 is secured to a mounting plate 1 whose one side surface is provided with a device 7 for mounting a carrier arm, a pair of cylinder support arms 2 for lock pins and a pair of support arms 3 for cartridge clamp arm attached vertically to the other side surface of said mounting plate 1, lock pins 4 attached to the piston rod ends of cylinders 20 for lock pins, said cylinders 20 being secured to said cylinder support arms 2, cartridge clamp arms 6 slidably fitted into guide pins 5 provided vertically in the outside of said support arms 3, and a pair of the cartridge clamp arms 6, 6 coupled through a cylinder 30 which opens or closes said arms. In a second embodiment of the invention, a cartridge system slide valve apparatus 13 compresses in itself positioning metal fittings 11 for fitting the lock pins 4 for the cartridge handling hand, and positioning pins 12 which fit in the positioning recesses of a cartridge 9. By such technical constitutions a hand according to the invention is mounted to the hand portion of a general purpose robot or the like and said cartridge is fixed to the SV apparatus whereby it becomes possible to carry out the replacement work without relying on human hands but totally automatically, and it is possible to reduce labor to a large extent. Further, even in cases when a conveying mechanism such as gravity-free balancer is used and requires a human hand, it is capable of achieving excellent functions and effects such that the operator is released from heavy labor.

BRIEF DESCRIPTION OF THE DRAWINGS

The invention will now be described more in detail, by way of preferred embodiments, with reference to the accompanying drawings in which

FIG. 7 is a schematic view showing a state in which the cartridge is held by the hand of the invention;

FIG. 8 is a schematic view showing a state in which the lock pin is fitted into and fixed to the positioning metal fitting of the SV apparatus;

FIG. 9 is a schematic view showing a state in which the cartridge is secured to the predetermined position of the SV apparatus;

FIG. 10 is a schematic view showing a state in which the door for surface pressure loading is moved above the cartridge;

FIG. 11 is a schematic view showing a state in which the slide plate is connected to the drive source by the nut runner; and FIG. 12 is a schematic view showing an example in which the hand of the invention is applied to the replacement of an insert nozzle.

DESCRIPTION OF THE PREFERRED EMBODIMENTS

Figure 1:
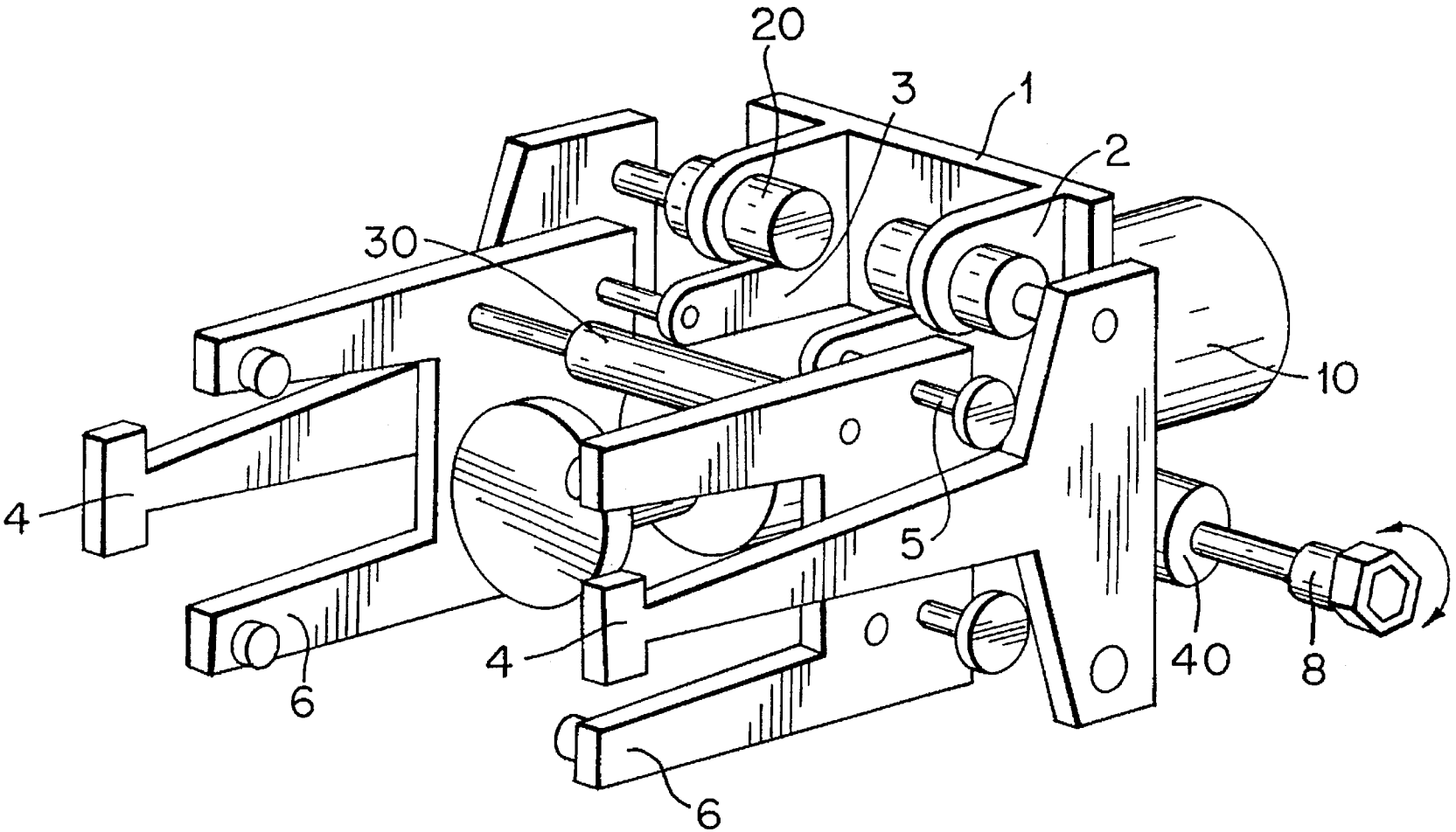
FIG. 1 is a perspective view showing one example of the cartridge handling hand of the invention.
Figure 2:
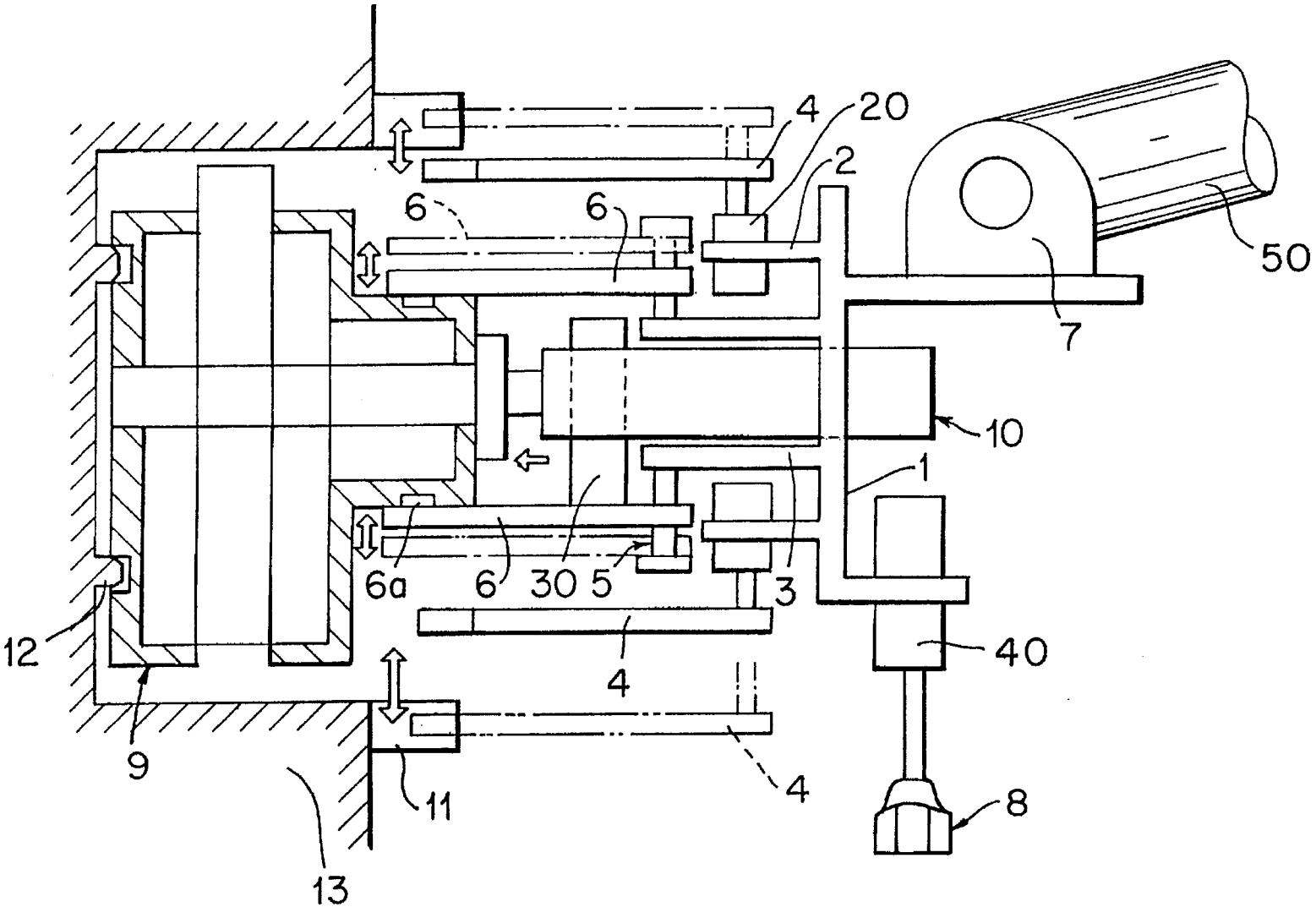
FIG. 2 is a side view showing an embodiment of use of the hand shown in FIG. 1.

Referring to FIGS. 1 and 2, the reference numeral 1 designates a mounting plate to be the basic body of the invention. One side surface (the opposite side to the side equipped with a cartridge support mechanism) is equipped with a mounting device 7 connectable and securable, for example, to a robot arm 50 and with a nut runner, and this nut runner consists of a driving mechanism such as a box spanner 8 and an electric or air pressure motor 40. Further, a cartridge pressing cylinder 10 is firmly secured to the center of said mounting plate 1 as shown in the drawings.

The other side surface of said mounting plate 1 is provided with a mechanism for retaining and pressing the cartridge, and while holding said cartridge pressing cylinder 10 support arms 3 for a pair of cartridge clamp arms 6 are vertically provided in the inside while arms 2 supporting the cylinders 20 for a pair of lock pins 4 are also vertically provided in the outside. Said support arms 3 for the cartridge clamp arms have guide pins 5 vertically provided externally, and the base portion of the cartridge clamp arms 6 is slidably fitted with said guide pins 5. Furthermore, the cartridge clamp arms 6, 6 are coupled through a cylinder 30 which opens or closes said arms. On the other hand, the lock pins 4 are fixed to the piston rod end of said cylinder for the lock pins, and it is constructed in such a way that said lock pins 4, 4 are fitted in and secured to positioning metal fittings 11, 11 arranged in an SV apparatus.

FIGS. 3 and 4 exemplify, by way of perspective views, combinations of the lock pin 4 and the positioning metal fitting 11.

Figure 3A:
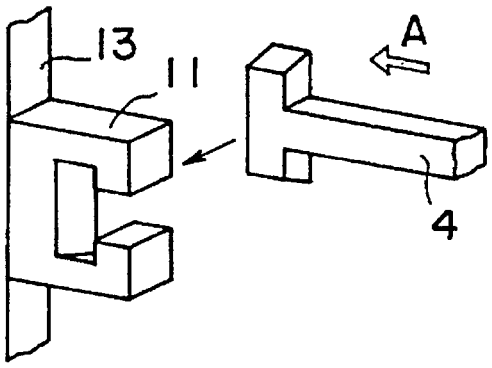
FIGS. 3*a* and 3*b* are perspective view showing a combination example of a lock pin and a positioning metal fitting.
Figure 3B:
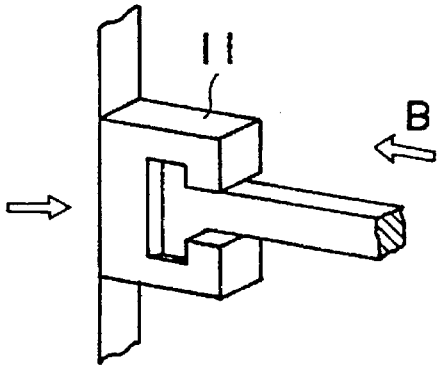
Figure 4A:
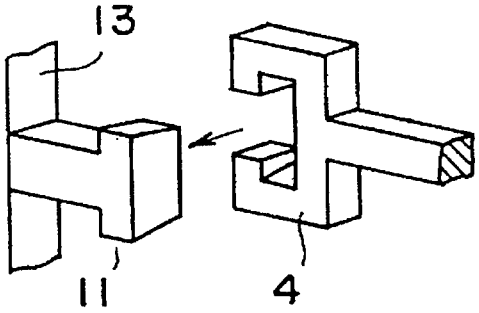
FIGS. 4*a* and 4*b* are perspective views showing a combination example of another lock pin and another positioning metal fitting.
Figure 4B:
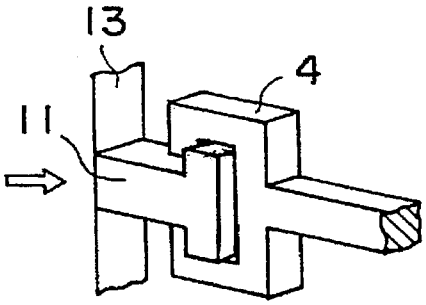
Figure 5A:
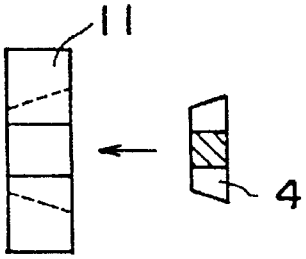
FIG. 5(*a*) is a schematic view when viewed in the arrow A direction in FIG. 3(*a*) whereas FIG. 5(*b*) is a schematic view when viewed in the arrow B direction in FIG. 3(*b*)
Figure 5B:
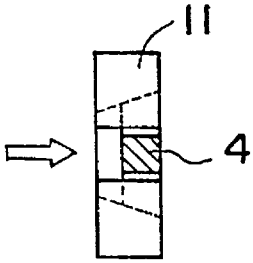

The embodiment of FIG. 3*a* shows a combination of a C-shape positioning metal fittings 11 mounted to the SV apparatus and T-shaped lock pins 4, whereas FIG. 3*b* exemplifies a state of the fitted and secured combination. FIG. 4*a* shows a combination of a T-shaped positioning metal fittings 11 mounted to the SV apparatus and C-shaped lock pins 4, whereas FIG. 4*b* exemplifies a state of the fitted and secured combination. FIG. 5*a* is a schematic view in the direction of an arrow A in FIG. 3*a* while FIG. 5*b* is a schematic view in the direction of an arrow B in FIG. 3*b*. Additionally, it is possible that the fitting (hooking) portion between the positioning metal fittings 11 and the lock pins 4 is of tapered, semi-conical or semi-spherical shape, and it will suffice if the combination is certainly secured.

Figure 6:
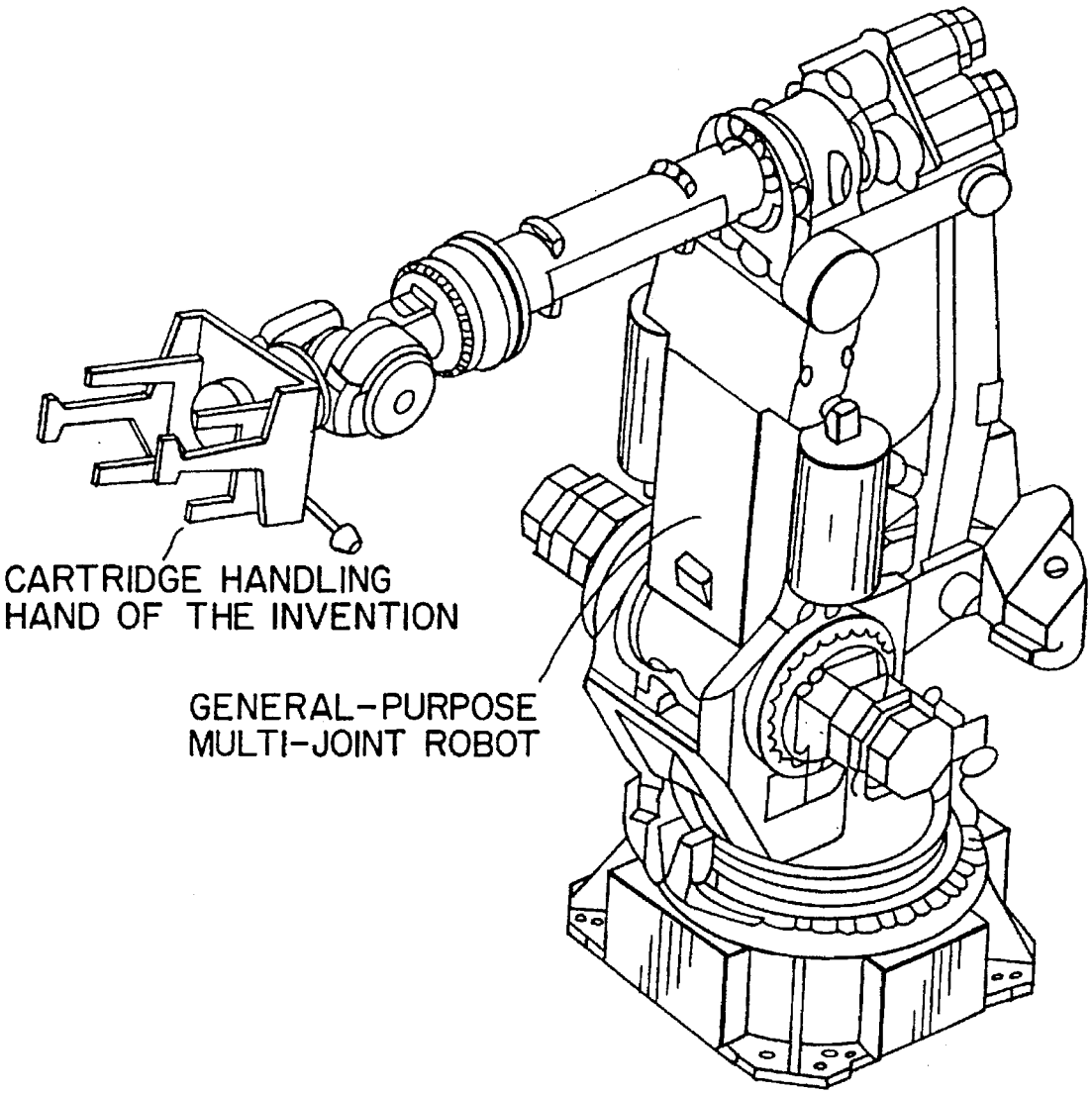
FIG. 6 is a perspective view of the hand of the invention, which is mounted to a multi-joint robot for general purposes.

The cartridge handling hand of the cartridge system SV apparatus of the present invention has a mechanism engageable with a general purpose robot, an exclusive machine for conveying, a general purpose manipulator of remote control type, a general purpose gravity-free balancer or the like, and FIG. 6 shows a perspective view where the hand of the invention is mounted to a general purpose multi-joint robot. In such case, as illustrated in FIG. 2, a hand-mounting device 7 of the invention is connected and secured to the robot arm 50, and by operating said robot a cartridge 9 is held and carried thereby to mount it to the SV apparatus.

An embodiment for mounting said cartridge 9 is described below in detail in a sequential procedure with reference to FIGS. 7 to 11.

As illustrated in FIG. 7, the cartridge 9 is clamped by closing the arms 6, 6 for cartridge clamping by operating the cylinder 30. In such case, preferably, recesses are provided at the places against which the cartridge clamping arms 6, 6 of the cartridge 9 about whereby projections 6*a*, 6*a* arranged inside the ends of said arms 6, 6 may fit into said recesses (see FIG. 2). Thus, the hand of the present invention, which is holding the cartridge 9, is conveyed to a predetermined position of the SV apparatus by operating the robot.

Then, as illustrated in FIG. 8, the cylinder 20 for lock pin is operated to allow the lock pins 4, 4 to be fitted into and secured to the positioning metal fittings 11, 11 arranged projectingly to the SV apparatus (when the pins 12 provided inside the SV apparatus engage with the recesses provided in front of the cartridge). The cartridge clamp arm 6 is then opened, but since the cartridge 9 is supported by said pins 12 and the end of said cartridge pressing cylinder 10, the cylinder 10 is operated thereafter thereby fitting and fixing the cartridge 9 into and to the predetermined position of the SV apparatus 13 (see FIG. 9).

Further, as illustrated in FIG. 10, surface pressure loading doors 14, 14 are moved onto the cartridge 9, a surface pressure is loaded to the cartridge 9 by an ordinary method, and the slide plate within the cartridge is coupled with the drive source by a nut runner (refer to FIG. 11).

The above is an explanation as to how a cartridge is mounted to the SV apparatus. Then, below is explained in summary an operation of disengaging the cartridge from the SV apparatus to replace the cartridge.

(a) The cartridge is disengaged from the drive source by a nut runner.

(b) The lock pins of the hand of the invention are hooked to the positioning metal fittings of the SV apparatus.

(c) The cartridge is clamped by the clamp arms 6.

(d) The cartridge is released from the surface pressure to permit the cartridge to be disengaged from the securing to the SV apparatus.

(e) The cartridge is carried out by a robot so to be handled up to an exclusive stand.

Though the hand of the invention has been explained above with regard to an application thereof to a replacement working of a cartridge for the SV apparatus, it is not limited to such example, and a jig at the end of the hand can be applied to replacement of an insert nozzle of the molten metal vessel, too, by modifying a little or replacting it. Such an example is schematically illustrated in FIG. 12 in which the reference numeral 15 designates a rod for carrying and drawing an insert nozzle 16.

EFFECTS OF THE INVENTION (a) By mounting, for use, the hand of the present invention to a carrying mechanism such as a general purpose robot a cartridge of the cartridge system SV apparatus can be replaced fully automatically without relying on human hands, and a heavy labor working exposed to high temperature can be avoided whereby labor can be reduced to a large extent.

(b) Even the work using a simple system such as gravity-free balancer or the like and requiring human hands can be released from a heavy labor at high temperature.

We claim:

1. A cartridge handling hand of a cartridge system sliding valve apparatus comprising:

a mounting plate;

a device attached to a first side surface of said mounting plate for mounting a carrier arm;

a cartridge pressing cylinder secured to said first side surface of said mounting plate;

a first pair of cylinder support arms and a second pair of support arms attached to a second side surface of said mounting plate;

lock pins fixed to said first pair of cylinder support arms for attachment to positioning metal fittings on said sliding valve apparatus;

guide pins arranged vertically in an outer side of said second pair of support arms;

cartridge clamp arms slidably fitted in said second pair of support arms; and a cylinder coupled to said cartridge clamp arms for opening and closing said cartridge clamp arms.

2. A cartridge handling hand according to claim 1 wherein said mounting plate includes a box spanner and a mechanism for driving said box spanner.

3. A cartridge handling hand according to claim 1 further comprising a mechanism mountable to a device selected from the group consisting of a general purpose robot, an exclusive machine for carrying, a general purpose remote control manipulator or a general purpose gravity-free balancer.

4. A cartridge handling hand according to claim 1 wherein said lock pins include a hooking portion for attachment to the positioning metal fittings, said hooking portion having a shape selected from the group consisting of tapered, semi-circular and semi-spherical.

5. A cartridge system slide valve apparatus comprising:

a body;

a cartridge handling hand including a mounting plate, a device attached to a first side surface of said mounting plate for mounting a carrier arm, a cartridge pressing cylinder secured to said first side surface of said mounting plate, a first pair of cylinder support arms and a second pair of support arms attached to a second side surface of said mounting plate, lock pins fixed to said first pair of cylinder support arms for attachment to positioning metal fittings on said sliding valve apparatus, guide pins arranged vertically in an outer side of said second pair of support arms, cartridge clamp arms slidably fitted in said second pair of support arms, and a cylinder coupled to said cartridge clamp arms for opening and closing said cartridge clamp arms;

positioning metal fittings on said body for engaging lock pins on a cartridge handling hand; and positioning pins on said body for engaging positioning recesses in a cartridge whereby a cartridge is replaceable.

* * * * *

UNITED STATES PATENT AND TRADEMARK OFFICE

CERTIFICATE OF CORRECTION

PATENT NO. : 5,645,793

DATED : July 8, 1997

INVENTOR(S) : YAMAMOTO et al.

It is certified that error appears in the above-indentified patent and that said Letters Patent is hereby corrected as shown below:

On the title page, item [75] should read:

[75] Inventors: Kenji Yamamoto, Okayama-ken; Mototsugu Osada, Bizen; Shuichi Aoyama; Koji Ishii, both of Okayama, all of Japan Signed and Sealed this Twentieth Day of January, 1998

*Attest:*

Bruce Lehman

BRUCE LEHMAN

*Attesting Officer*

*Commissioner of Patents and Trademarks*